US010407844B1

(12) United States Patent
Nelson et al.

(10) Patent No.: US 10,407,844 B1
(45) Date of Patent: Sep. 10, 2019

(54) MATERIAL FEED SYSTEM FOR A PAVING MACHINE

(71) Applicant: Caterpillar Paving Products Inc., Brooklyn Park, MN (US)

(72) Inventors: Ryan James Nelson, Maple Grove, MN (US); Mathew James Hedrington, Ham Lake, MN (US); Toby Andrew Frelich, Saint Michael, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 0 days.

(21) Appl. No.: 15/959,441

(22) Filed: Apr. 23, 2018

(51) Int. Cl.
*E01C 19/00* (2006.01)
*E01C 19/48* (2006.01)

(52) U.S. Cl.
CPC ..... *E01C 19/48* (2013.01); *E01C 2301/02* (2013.01)

(58) Field of Classification Search
CPC ..... E01C 19/49; E01C 2301/02; E01C 19/48
USPC ..... 404/84.05–84.5, 104–104, 118
See application file for complete search history.

(56) References Cited

U.S. PATENT DOCUMENTS 5,484,227 A * 1/1996 Ikeda ..... E01C 19/006 404/118
5,575,583 A * 11/1996 Grembowicz ..... E01C 19/48 404/72
7,484,911 B2 2/2009 Frelich
8,099,218 B2 1/2012 Glee et al.
8,562,246 B2 10/2013 Utterodt et al.
8,794,868 B2 8/2014 Fritz
8,930,092 B2 1/2015 Minich
9,004,811 B2 4/2015 Mings et al.
9,255,364 B2 2/2016 Ichikawa
9,505,567 B2 11/2016 Swearingen
10,227,738 B2 3/2019 Horn et al.
10,246,833 B2 4/2019 Blank et al.
2014/0099165 A1* 4/2014 Smieja ..... E01C 19/48 404/72

FOREIGN PATENT DOCUMENTS

CN 1395008 2/2003
CN 105568824 5/2016
DE 102012209495 7/2014
DE 102014014384 4/2016

* cited by examiner

*Primary Examiner* — Raymond W Addie
(74) *Attorney, Agent, or Firm* — Oblon, McClelland, Maier & Neustadt

(57) ABSTRACT

A material feed system for a paving machine includes a first optical sensor and a second optical sensor that are configured to generate data characteristic of paving material associated with corresponding ones of a left feed mechanism and a right feed mechanism of the paving machine. A controller is communicably coupled to the first optical sensor, the second optical sensor, a left conveyor, and a left auger of the left feed mechanism, and a right conveyor and a right auger of the right feed mechanism. The controller is configured to control the left material feed mechanism and the right material feed mechanism independently of each other such that the left conveyor and auger speeds are independently adjusted based on the data received from the first optical sensor and the right conveyor and auger speeds are independently adjusted based on the data received from the second optical sensor.

16 Claims, 4 Drawing Sheets

MATERIAL FEED SYSTEM FOR A PAVING MACHINE

TECHNICAL FIELD

The present disclosure relates to a paving machine. More particularly, the present disclosure relates to the material feed system associated with a paving machine.

BACKGROUND

Typically, an asphalt paving machine includes a material feed system installed thereon. The material feed system may feed asphalt from a hopper portion of the machine to a screed portion of the machine. The material feed system may include a pair of conveyors and a pair of augers that are located adjacent to the screed. The conveyors may be configured to rotate in a direction that is generally parallel to a direction of travel of the machine for conveying the asphalt from the hopper to corresponding ones of the augers. The augers, in turn, rotate in a direction that is generally transverse to the direction of travel of the machine so that the conveyed asphalt can be distributed as per requirements of a paving application.

U.S. Pat. No. 9,255,364 (hereinafter referred to as "the '364 patent") discloses an image generating apparatus for a paving machine, and an operation support system that employs the image generating apparatus for assisting an operator of the paving machine in identifying blind areas and obstacles that may be present in the vicinity of the machine. The operation support system of the '364 patent provides the operator with data to facilitate movement of the paving machine in relation to the blind areas and obstacles.

Although the image generating apparatus and the operation support system of the '364 patent may help in facilitating movement of the paving machine, other functions of the paving machine can also be rendered in an efficient manner to improve an overall functionality provided by the paving machine. For instance, in some cases, it may be desirable to control a movement associated with each auger and each conveyor so that the machine can perform the paving operation without much manual intervention by the operator.

SUMMARY OF THE DISCLOSURE

In an aspect of the present disclosure, a material feed system for a paving machine is provided. The paving machine has a hopper for holding a volume of paving material therein. The paving machine also includes a left material feed mechanism having a left conveyor and a left auger provided in association with the left conveyor, and a right material feed mechanism that has a right conveyor and a right auger provided in association with the right conveyor. The paving machine further includes a screed assembly that is pivotally coupled to a frame of the paving machine. The material feed system includes a first optical sensor that is provided in association with the left auger and configured to generate data that is characteristic of paving material associated with the left feed mechanism. The material feed system further includes a second optical sensor provided in association with the right auger and configured to generate data that is characteristic of paving material associated with the right feed mechanism. The material feed system also includes a controller that is communicably coupled to each of the first optical sensor, the left conveyor, the left auger, the second optical sensor, the right conveyor, and the right auger. The controller is configured to receive the data characteristic of paving material associated with the left feed mechanism and the right feed mechanism from corresponding ones of the first optical sensor and the second optical sensor respectively. The controller is then configured to control each of the left material feed mechanism and the right material feed mechanism independently of each other, wherein speeds of corresponding ones of the left conveyor and the left auger are independently adjusted based on the data received from the first optical sensor and speeds of corresponding ones of the right conveyor and the right auger are independently adjusted based on the data received from the second optical sensor.

In another aspect of the present disclosure, a method for controlling a material feed system that is associated with a paving machine is provided. The paving machine has a frame and hopper mounted on the frame for holding a volume of paving material therein. The paving machine also includes a screed assembly that is pivotally coupled to the frame. The material feed system includes a left material feed mechanism having a left conveyor and a left auger provided in association with the left conveyor. The material feed system also includes a right material feed mechanism having a right conveyor and a right auger provided in association with the right conveyor. The method includes receiving data characteristic of paving material that is associated with the left feed mechanism from a first optical sensor. The method also includes receiving data characteristic of paving material that is associated with the right feed mechanism from a second optical sensor. The method further includes controlling, using a controller, each of the left material feed mechanism and the right material feed mechanism independently of each other such that speeds of corresponding ones of the left conveyor and the left auger are independently adjusted based on the data received from the first optical sensor and speeds of corresponding ones of the right conveyor and the right auger are independently adjusted based on the data received from the second optical sensor.

In yet another aspect of the present disclosure, a paving machine is provided. The paving machine includes a frame, a hopper mounted on the frame for holding a volume of paving material therein, and a screed assembly pivotally coupled to the frame. The paving machine includes a material feed system that is disposed on the frame and located between the hopper and the screed assembly. The material feed system includes a left material feed mechanism and a right material feed mechanism that are configured to communicate paving material from the hopper to the screed assembly. The left material feed mechanism has a left conveyor and a left auger that is provided in association with the left conveyor. The right material feed mechanism has a right conveyor and a right auger that is provided in association with the right conveyor. The material feed system also includes a first optical sensor that is provided in association with the left auger. The first optical sensor is configured to generate data characteristic of paving material associated with the left feed mechanism. The material feed system further includes a second optical sensor that is provided in association with the right auger. The second optical sensor is configured to generate data characteristic of paving material that is associated with the right feed mechanism. The material feed system also includes a controller that is communicably coupled to each of the first optical sensor, the left conveyor, the left auger, the second optical sensor, the right conveyor, and the right auger. The controller is configured to receive the data characteristic of paving material associated with the left feed mechanism from the first optical sensor and the data characteristic of paving material associated with the right feed mechanism from the second optical sensor. The controller is also configured to control each of the left material feed mechanism and the right material feed mechanism independently of each other such that speeds of corresponding ones of the left conveyor and the left auger are independently adjusted based on the data received from the first optical sensor and speeds of corresponding ones of the right conveyor and the right auger are independently adjusted based on the data received from the second optical sensor.

Other features and aspects of this disclosure will be apparent from the following description and the accompanying drawings.

DETAILED DESCRIPTION

Figure 1:
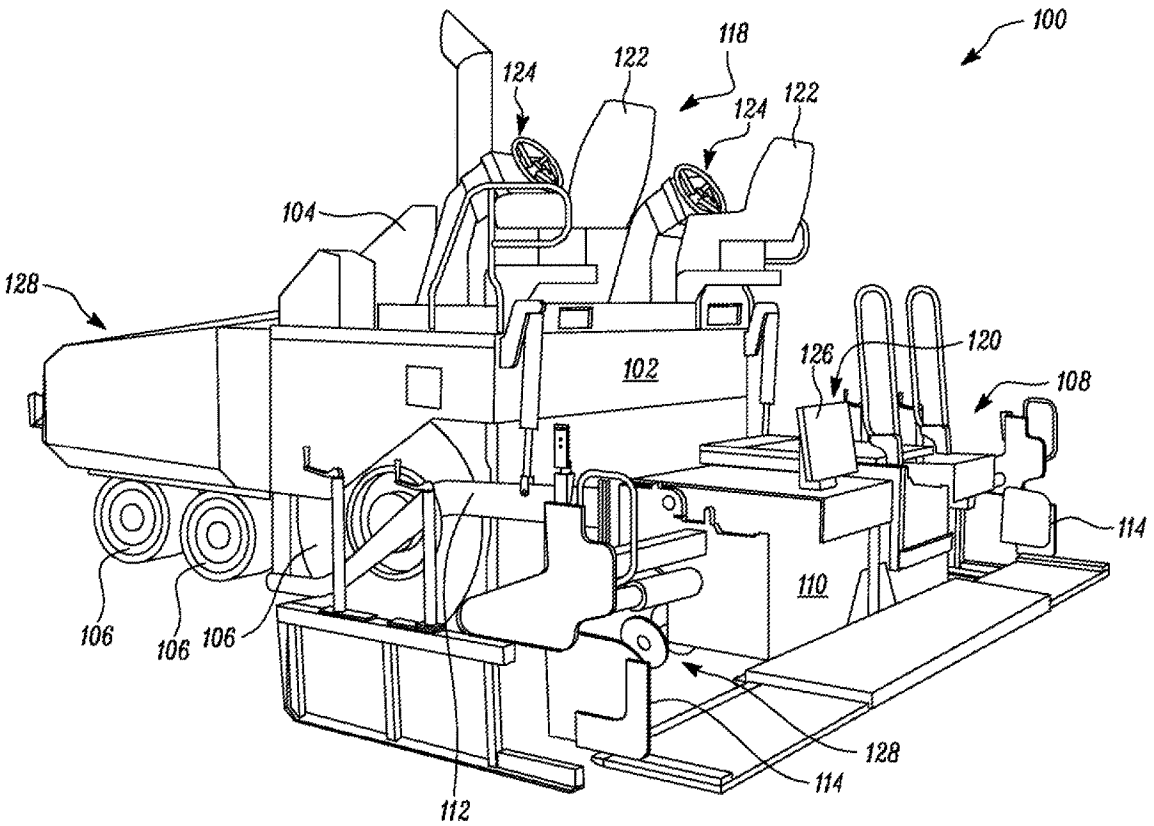
FIG. 1 is a perspective view of an exemplary machine, according to an embodiment of the present disclosure.

Wherever possible, the same reference numbers will be used throughout the drawings to refer to the same or the like parts. Referring to FIG. 1, an exemplary paving machine 100 is illustrated. For sake of simplicity, the paving machine 100 is hereinafter referred to as 'the machine' and denoted by identical numeral '100'. The machine 100 includes a frame 102. The frame 102 is adapted to support various components of the machine 100 thereon. The machine 100 includes an enclosure 104 mounted on the frame 102. The enclosure 104 is adapted to enclose a power source (not shown) therein. The power source may be any power source known in the art, such as an internal combustion engine, batteries, motor, and so on. The power source is adapted to provide power to the machine 100 for operational and mobility requirements.

The machine 100 also includes a plurality of ground engaging members 106 movably coupled to the frame 102. In the illustrated embodiments, the ground engaging members 106 include wheels. In other embodiments, the ground engaging members 106 may include tracks. The ground engaging members 106 are adapted to support and provide maneuverability to the machine 100 on a ground surface. The machine 100 also includes a screed assembly 108 mounted on the frame 102. The screed assembly 108 will be hereinafter interchangeably referred to as the "assembly 108". The assembly 108 includes a main screed 110 movably mounted on the frame 102. More specifically, the main screed 110 is coupled to an end of a tow arm 112. The other end of the tow arm 112 may be pivotally connected to the frame 102 of the machine 100 in a manner for towing the assembly 108. The assembly 108 may pivot about the pivotal connection with the frame 102 to float freely over an asphalt surface being paved.

The assembly 108 may also include one or more screed extensions 114 mounted on the main screed 110. The screed extensions 114 are movably coupled to the main screed 110. In one embodiment, the main screed 110 may include a screed extension carriage 116, for mounting the screed extensions 114. In some embodiments, the screed extensions 114 may be mounted rearwardly of the main screed 110. In yet other embodiments, the screed extensions 114 may be mounted in front of the main screed 110, based on application requirements.

The machine 100 also includes a machine operator station 118 mounted on the frame 102. The machine operator station 118 is configured to control various functions associated with the machine 100 and, in some embodiments, functions associated with the assembly 108. The machine 100 also includes a screed operator station 120. The screed operator station 120 is configured to control various functions associated with the assembly 108 and, in some embodiments, functions associated with the machine 100. The machine operator station 118 may include one or more seats 122 for an operator. Further, each of the machine operator station 118 and the screed operator station 120 may include respective operator interfaces 124, 126. The operator interfaces 124, 126 may be configured to receive various inputs from the operator and for displaying information to the operator during operation of the machine 100 and/or the assembly 108.

Figure 2:
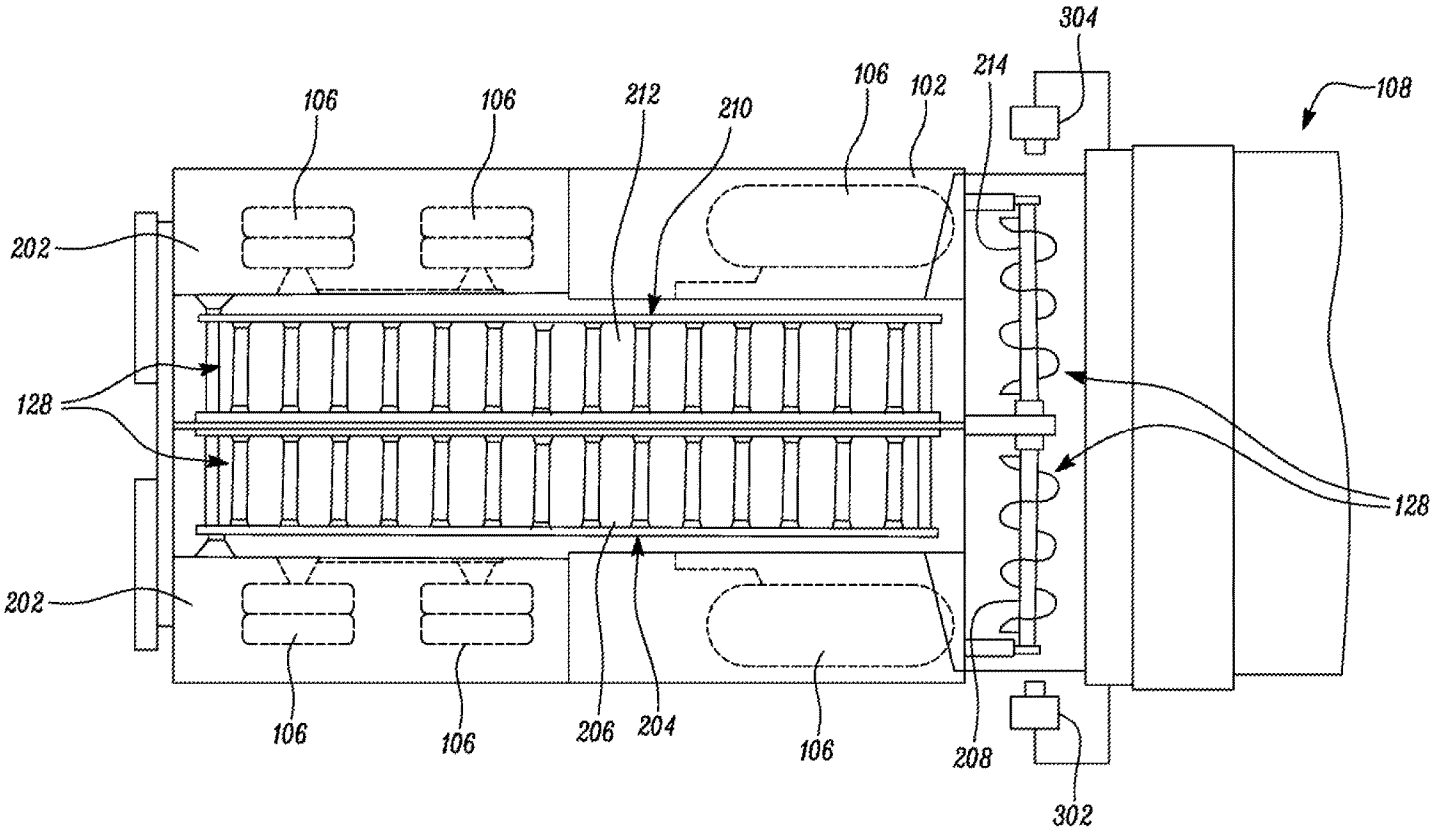
FIG. 2 is a schematic top view of a portion of the machine of FIG. 1, according to an embodiment of the present disclosure.

The machine 100 also includes a material feed system 128 mounted on the frame 102. The material feed system 128 will be hereinafter interchangeably referred to as the "system 128". The system 128 is adapted to receive paving material on the machine 100 and transfer the paving material from one portion of the machine 100 to another. Referring to FIG. 2, a schematic top view of the system 128 is illustrated. The system 128 includes a hopper 202. The hopper 202 is adapted to hold a volume of the paving material therein. This paving material, for example, asphalt, may be received from an external source (not shown), such as a truck or another type of a transfer vehicle.

The system 128 includes a left material feed mechanism 204. The left material feed mechanism 204 will be hereinafter interchangeably referred to as the "left mechanism 204". The left mechanism 204 includes a left conveyor 206 and a left auger 208. The left auger 208 is disposed rearwardly and adjacent to an end of the left conveyor 206. The left conveyor 206 transfers the paving material from the hopper 202 to the left auger 208 in a direction generally parallel to a direction of travel of the machine 100. The left conveyor 206 may be any conveying element known in the art, such as a belt type conveyor, a feeder bar type conveyor, and so on. The left auger 208 is adapted to distribute the paving material in front of the assembly 108 and laterally in a direction generally perpendicular to the direction of travel of the machine 100. The left auger 208 may be any conveying element known in the art, such as a screw type conveyor, a rotating type conveyor, and so on.

The system 128 also includes a right material feed mechanism 210. The right material feed mechanism 210 will be hereinafter interchangeably referred to as the "right mechanism 210". The right mechanism 210 includes a right conveyor 212 and a right auger 214. The right conveyor 212 is disposed rearwardly and adjacent to an end of the right conveyor 206. The right conveyor 212 transfers the paving material from the hopper 202 to the right auger 214 in the direction generally parallel to the direction of travel of the machine 100. The right conveyor 212 may be any conveying element known in the art such as a belt type conveyor, a feeder bar type conveyor, and so on. The right auger 214 is adapted to distribute the paving material in front of the assembly 108 and laterally in the direction generally perpendicular to the direction of travel of the machine 100. The right auger 214 may be any conveying element known in the art, such as a screw type conveyor, a rotating type conveyor, and so on.

Figure 3:
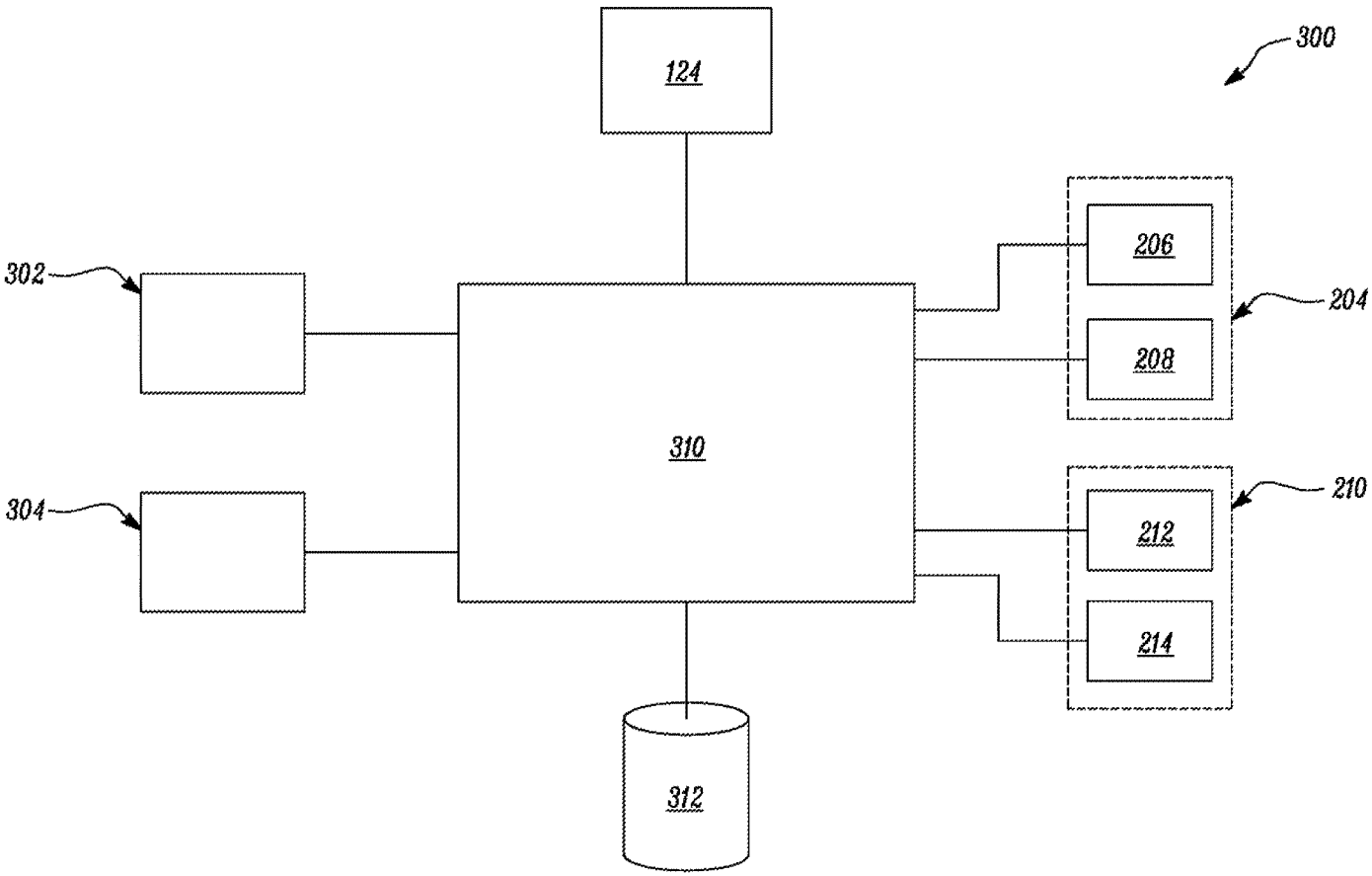
FIG. 3 is a schematic representation of a material feed system of the machine of FIG. 2, according to an embodiment of the present disclosure.

The present disclosure relates to a control system for the system 128. FIG. 3 shows a schematic representation of one embodiment of a control system 300. The control system 300 includes a first optical sensor 302. The first optical sensor 302 is configured to generate data that is characteristic of paving material associated with the left mechanism 204. In an embodiment, the first optical sensor 302 may be a visual camera. In another embodiment, the first optical sensor 302 may include a light detection and ranging (LIDAR) system. It should be understood, however, that other types of optical sensors known in the art may be implemented in lieu of the visual camera or the LIDAR system to generate data that is characteristic of paving material associated with the left mechanism 204.

The control system 300 also includes a second optical sensor 304. The second optical sensor 304 is provided in association with the right auger 214. The second optical sensor 304 is configured to generate data that is characteristic of paving material associated with the right mechanism 210. In an embodiment, the second optical sensor 304 may be a visual camera. In another embodiment, the second optical sensor 304 may include a light detection and ranging (LIDAR) system. It should be understood, however, that other types of optical sensors known in the art may be implemented in lieu of the visual camera or the LIDAR system to generate data that is characteristic of paving material associated with the right mechanism 210.

The control system 300 also includes a controller 310. The controller 310 may be any control unit known in the art configured to perform various functions of the control system 300. In one embodiment, the controller 310 may be a dedicated control unit configured to perform functions related to the control system 300. In another embodiment, the controller 310 may be a Machine Control Unit (MCU) or an Electronic Control Module (ECM) associated with the machine 100, an Engine Control Unit (ECU) associated with the engine, and so on, configured to perform functions related to the control system 300.

The controller 310 is communicably coupled to each of the first optical sensor 302, the left conveyor 206, the left auger 208, the second optical sensor 304, the right conveyor 212, and the right auger 214. More specifically, in one embodiment, the controller 310 may be communicably coupled to an electronic displacement control unit (not shown) of a variable displacement piston pump (not shown) associated with each of the left conveyor 206, the left auger 208, the right conveyor 212, and the right auger 214. In another embodiment, the controller 310 may be communicably coupled to an electric motor (not shown) or other rotational actuator (not shown) associated with each of the left auger 208, the left conveyor 206, the right auger 214, and the right conveyor 212.

The controller 310 is configured to receive the data characteristic of the paving material associated with the left mechanism 204 from the first optical sensor 302. In an embodiment, the data, that is characteristic of paving material associated with the left mechanism 204 and, generated by the first optical sensor 302 may include an amount of paving material that is present adjacent to the left auger 208.

In another embodiment, the data generated by the first optical sensor 302 could further include a flow rate of paving material that is being conveyed from the left conveyor 206 to the left auger 208. In yet another embodiment, the data generated by the first optical sensor 302 may further include an amount of paving material that is present at the left auger 208. In yet another embodiment, the data generated by the first optical sensor 302 may further include a height of the paving material present at the left auger 208 and/or a height of paving material that is present adjacent to the screed assembly 108. Additionally, or optionally, in another embodiment, the data generated by the first optical sensor 302 may include a segregation of the paving material at the left auger 208. In embodiments herein, the data generated by the first optical sensor 302 could also include a flow pattern that would be indicative of a movement and a speed of movement that is associated with the paving material in multiple directions, for example, in a spatial volume of the paving material at, or adjacent to, the left auger 208 and/or the screed assembly 108.

The controller 310 is also configured to receive the data characteristic of the paving material associated with the paving material in the right mechanism 210 from the second optical sensor 304. In an embodiment, the data, that is characteristic of paving material associated with the right mechanism 210 and, generated by the second optical sensor 304 may include an amount of paving material that is present adjacent to the right auger 214.

In another embodiment, the data generated by the second optical sensor 304 could further include a flow rate of paving material that is being conveyed from the right conveyor 212 to the right auger 214. In yet another embodiment, the data generated by the second optical sensor 304 may further include an amount of paving material that is present at the right auger 214. In yet another embodiment, the data generated by the second optical sensor 304 may further include a height of the paving material present at the right auger 214 and/or a height of paving material present adjacent to the screed assembly 108. Additionally, or optionally, in an embodiment, the data generated by the second optical sensor 304 may include a segregation of the paving material at the right auger 214. In embodiments herein, the data generated by the second optical sensor 304 could also include a flow pattern that would be indicative of a movement and a speed of movement that is associated with the paving material in multiple directions, for example, in a spatial volume of the paving material at, or adjacent to, the right auger 214 and/or the screed assembly 108.

The controller 310 is further configured to control a speed of each of the left mechanism 204 and/or the right mechanism 210 selectively and independently of each other. Specifically, the controller 310 is configured to control a speed of each of the left mechanism 204 and the right mechanism 210 independently of each other such that speeds of corresponding ones of the left conveyor 206 and the left auger 208 are independently adjusted based on the data received from the first optical sensor 302 and speeds of corresponding ones of the right conveyor 212 and the right auger 214 are independently adjusted based on the data received from the second optical sensor 304.

By providing data that is characteristic of the paving material associated with the left and right feed mechanisms 204, 210 from the first and second optical sensors 302, 304 to the controller 310, and by allowing the controller 310 to independently adjust speeds of each of the left conveyor 206, the left auger 208, the right conveyor 212, and the right auger 214, the controller 310 of the present disclosure can be facilitated to work in a first mode of the control system 300. The terms 'first mode' disclosed herein can be regarded as an auto-mode that represents a fully autonomous mode of the paving machine 100, and more specifically, of the material feed system 128 of the paving machine 100. An operator can select an appropriate one of the user-selectable options provided on at least one of the operator interfaces 124, 126 from corresponding ones of the machine and screed operator stations 118, 120 to actuate the controller 310 into implementing the 'first mode' for use in independently controlling or adjusting the speeds of each of the left conveyor 206, the left auger 208, the right conveyor 212, and the right auger 214 of the material feed system 128.

In another embodiment, the operator can instead select another appropriate one of the user-selectable options provided on at least one of the operator interfaces 124, 126 from corresponding ones of the machine and screed operator stations 118, 120 to actuate the controller 310 into implementing a second mode of operation. The second mode disclosed herein may represent a semi-autonomous mode of the system 128. In this embodiment, based on the data received from the first and second optical sensors 302, 304, the controller 310 may only be configured to control the speeds of corresponding ones of the left auger 208 and the right auger 214 respectively, and also control the speeds of corresponding ones of the left conveyor 206 and the right conveyor 212 based on a function of the speeds of corresponding ones of the left auger 208 and the right auger 214 respectively.

It should be noted that, in the foregoing embodiment, as the controller 310 controls the speed of the left conveyor 206 as a function of the speed of the left auger 208, and the speed of the right conveyor 212 as a function of the speed of the right auger 214, the associated function between each auger 208, 214 and its corresponding conveyor 206, 212, for example, a proportional, proportional-integral (PI), or proportional-integral-derivative (PID) gain and hence, a magnitude of modulation to the speeds of the left conveyor 206 and the right conveyor 212 may be variably adjusted by the operator via appropriate controls, for example, a pair of conveyor ratio dials (not shown) that may be provided on at least one of the operator interfaces 124, 126.

In another embodiment of this disclosure, each of the first and second optical sensors 302, 304 may also be configured to output data that is indicative of a height of corresponding ones of the left and right augers 208, 214 from a ground surface to the controller 310. In this embodiment, the controller 310 may, in turn, be configured to also adjust the heights of corresponding ones of the left and right augers 208, 214 from the ground surface based on the received heights of corresponding ones of the left and right augers 208, 214 from the first and second optical sensors 302, 304 respectively.

In an embodiment of the second mode, the speed of the left conveyor 206 may be controlled as the function of the speed of the left auger 208 based on a dataset (not shown). The dataset may be stored in a database 312 communicably coupled to the controller 310 or a memory (not shown) of the controller 310. In one embodiment, the dataset may include different values of the speed of the left conveyor 206 for varying values of the speed of the left auger 208. In another embodiment, the dataset may include a mathematical model representing a mathematical relationship between the speed of the left conveyor 206 and the speed of the left auger 208. In such a situation, the controller 310 may derive the speed of the left conveyor 206 based on the speed of the left auger 208 using the mathematical model.

Similarly, in an embodiment of the second mode, the speed of the right conveyor 212 may be controlled as the function of the speed of the right auger 214 based on a dataset. The dataset may be stored in the database 312 or the memory of the controller 310. In one embodiment, the dataset may include different values of the speed of the right conveyor 212 for varying values of the speed of the right auger 214. In another embodiment, the dataset may include a mathematical model representing a mathematical relationship between the speed of the right conveyor 212 and the speed of the right auger 214. In such a situation, the controller 310 may derive the speed of the right conveyor 212 based on the speed of the right auger 214 using the mathematical model.

Figure 4:
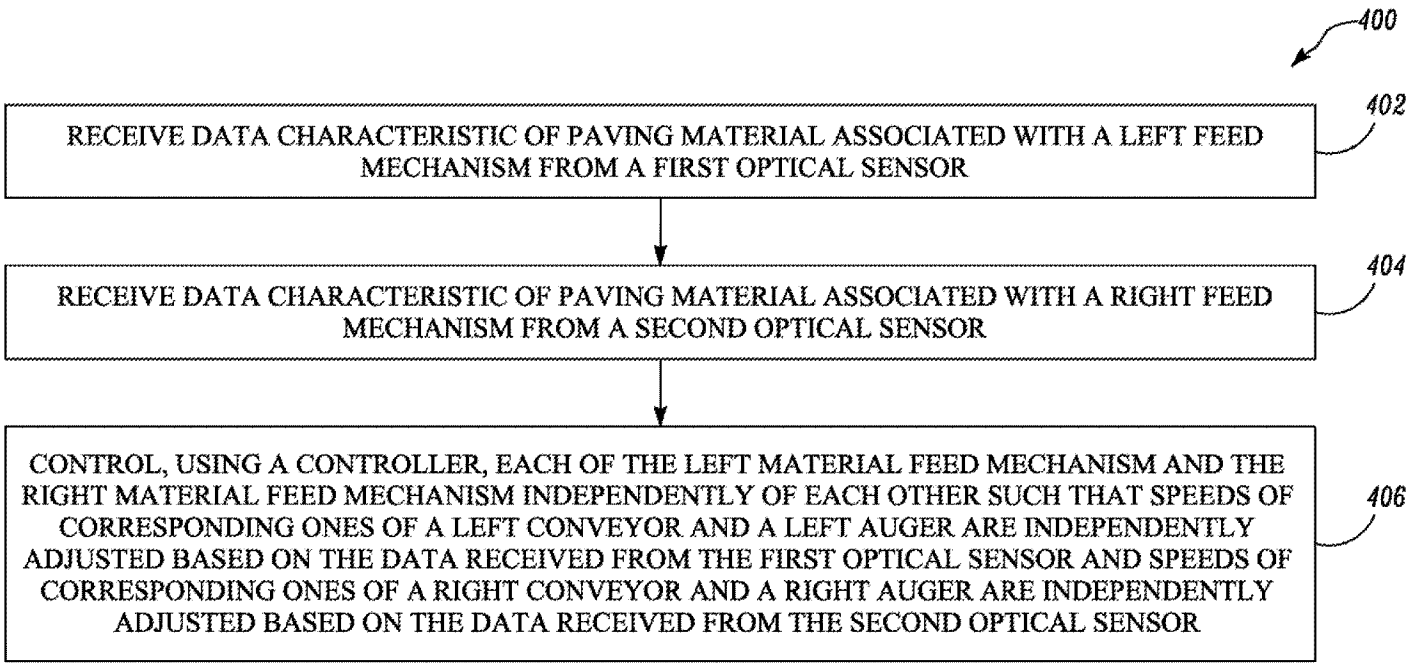
FIG. 4 is a flowchart illustrating a method of controlling the material feed system of FIG. 3, according to an embodiment of the present disclosure.

FIG. 4 is a flowchart depicting a method 400 of controlling the material feed system 128. As shown, at step 402, the method 400 includes receiving data characteristic of paving material that is associated with the left feed mechanism 204 from the first optical sensor 302. At step 404, the method 400 also includes receiving data characteristic of paving material that is associated with the right feed mechanism 210 from the second optical sensor 304. At step 406, the method 400 further includes controlling, using the controller 310 disclosed herein, each of the left mechanism 204 and the right mechanism 210 independently of each other such that speeds of corresponding ones of the left conveyor 206 and the left auger 208 are independently adjusted based on the data received from the first optical sensor 302 and speeds of corresponding ones of the right conveyor 212 and the right auger 214 are independently adjusted based on the data received from the second optical sensor 304.

INDUSTRIAL APPLICABILITY

The present disclosure has applicability for use in improving an accuracy of input data that may be required to accomplish an independent control in the left mechanism 204 and the right mechanism 210, more specifically, in independently controlling the speeds of movement associated with each of the left conveyor 206, the left auger 208, the right conveyor 212, and the right auger 214 respectively.

With use of the first and second optical sensors 302, 304, data characteristic of the paving material associated with the left and right feed mechanisms 204, 206 can be provided to the controller 310. In embodiments herein, it is envisioned that the data characteristic of the paving material associated with the left and right feed mechanisms 204, 206 would be comprehensive as opposed to that previously being used as inputs as such previously used data may be minimal and hence, inadequate for accomplishing an accurate and independent control in the operations that would be typically associated with various components of material feed mechanisms of paving machines.

With the use of the pair of optical sensors 302, 304 with corresponding ones of the left and right augers 208, 214, it is also hereby contemplated that a component count of sensors and/or other devices used in controlling operations of material feed mechanisms in previously known paving machines could now be reduced therefore, entailing lower costs than that would otherwise be incurred with the use of non-optical sensors, for example, sonic type sensors, paddle type sensors, or other types of sensors known in the art. In addition, the use of the pair of optical sensors 302, 304 can reduce complexity in the configuration of the system 300 that may be required for controlling operation of the left and right feed mechanisms 204, 206.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of the disclosure. Such embodiments should be understood to fall within the scope of the present disclosure as determined based upon the claims and any equivalents thereof.

What is claimed is:

1. A material feed system for a paving machine having a hopper for holding a volume of paving material, a left material feed mechanism including a left conveyor and a left auger provided in association with the left conveyor, a right material feed mechanism including a right conveyor and a right auger provided in association with the right conveyor, and a screed pivotally coupled to a frame of the paving machine, the material feed system comprising:

a first optical sensor provided in association with the left auger, the first optical sensor configured to generate data characteristic of paving material associated with the left feed mechanism;

a second optical sensor provided in association with the right auger, the second optical sensor configured to generate data characteristic of paving material associated with the right feed mechanism; and a controller communicably coupled to each of the first optical sensor, the left conveyor, the left auger, the second optical sensor, the right conveyor, and the right auger, the controller configured to:

receive the data characteristic of paving material associated with the left feed mechanism from the first optical sensor;

receive the data characteristic of paving material associated with the right feed mechanism from the second optical sensor; and control each of the left material feed mechanism and the right material feed mechanism independently of each other, wherein speeds of corresponding ones of the left conveyor and the left auger are independently adjusted based on the data received from the first optical sensor and speeds of corresponding ones of the right conveyor and the right auger are independently adjusted based on the data received from the second optical sensor, wherein each of the first and second optical sensors are configured to output data indicative of a height of corresponding ones of the left and right augers from a ground surface to the controller, and wherein the controller is configured to adjust the heights of corresponding ones of the left and right augers from the ground surface based on the received heights of corresponding ones of the left and right augers from the first and second optical sensors respectively.

2. The material feed system of claim 1, wherein the data characteristic of paving material associated with the left feed mechanism includes at least one of:

an amount of paving material adjacent to the left auger;

a flow rate of paving material from the left conveyor to the left auger;

an amount of paving material at the left auger;

a height of paving material at the left auger;

a height of paving material adjacent to the screed; and a segregation of paving material at the left auger.

3. The material feed system of claim 1, wherein the data characteristic of paving material associated with the right feed mechanism includes at least one of:

an amount of paving material adjacent to the right auger;

a flow rate of paving material from the right conveyor to the left auger;

an amount of paving material at the right auger;

a height of paving material at the right auger;

a height of paving material adjacent to the screed; and a segregation of paving material at the right auger.

4. The material feed system of claim 1, wherein each of the first and second optical sensors include one of: a camera, and a LIDAR.

5. The material feed system of claim 1, wherein the controller is configured to:

control the speeds of corresponding ones of the left auger and the right auger based on the data received from the first optical sensor and the second optical sensor respectively, and control the speeds of corresponding ones of the left conveyor and the right conveyor based on a function of the speeds of corresponding ones of the left auger and the right auger respectively.

6. A method for controlling a material feed system associated with a paving machine having a hopper for holding a volume of paving material, a left material feed mechanism including a left conveyor and a left auger provided in association with the left conveyor, a right material feed mechanism including a right conveyor and a right auger provided in association with the right conveyor, and a screed pivotally coupled to a frame of the paving machine, the method comprising:

receiving data characteristic of paving material associated with the left feed mechanism from a first optical sensor;

receiving data characteristic of paving material associated with the right feed mechanism from a second optical sensor; and controlling, using a controller, each of the left material feed mechanism and the right material feed mechanism independently of each other such that speeds of corresponding ones of the left conveyor and the left auger are independently adjusted based on the data received from the first optical sensor and speeds of corresponding ones of the right conveyor and the right auger are independently adjusted based on the data received from the second optical sensor, wherein the received data characteristic of paving material associated with the left feed mechanism and/or the right feed mechanism includes all of:

an amount of paving material adjacent to the left auger;

a flow rate of paving material from the left conveyor to the left auger;

an amount of paving material at the left auger;

a height of paving material at the left auger;

a height of paving material adjacent to the screed, and a segregation of paving material at the left auger, and wherein the controlling using the controller controls the left material feed mechanism and/or the right material feed mechanism based on at least one of the received data characteristic of paving material associated with the left feed mechanism and/or the right feed mechanism, respectively.

7. The method of claim 6, wherein each of the first and second optical sensors include one of: a camera, and a LIDAR.

8. The method of claim 6, wherein each of the first and second optical sensors are configured to output data indicative of a height of corresponding ones of the left and right augers from a ground surface to the controller.

9. The method of claim 8, wherein the controller is configured to adjust the heights of corresponding ones of the left and right augers from the ground surface based on the received heights of corresponding ones of the left and right augers from the first and second optical sensors respectively.

10. The method of claim 6 further comprising:

controlling, by the controller, the speeds of corresponding ones of the left auger and the right auger based on the data received from the first optical sensor and the second optical sensor respectively, and controlling, by the controller, the speeds of corresponding ones of the left conveyor and the right conveyor based on a function of the speeds of corresponding ones of the left auger and the right auger respectively.

11. A paving machine comprising:

a frame;

a hopper mounted on the frame for holding a volume of paving material therein;

a screed assembly pivotally coupled to the frame; and a material feed system disposed on the frame and located between the hopper and the screed assembly, the material feed system including:

a left material feed mechanism and a right material feed mechanism that are configured to communicate paving material from the hopper to the screed assembly, wherein the left material feed mechanism has a left conveyor and a left auger provided in association with the left conveyor, and wherein the right material feed mechanism has a right conveyor and a right auger provided in association with the right conveyor;

a first optical sensor provided in association with the left auger, the first optical sensor configured to generate data characteristic of paving material associated with the left feed mechanism;

a second optical sensor provided in association with the right auger, the second optical sensor configured to generate data characteristic of paving material associated with the right feed mechanism; and a controller communicably coupled to each of the first optical sensor, the left conveyor, the left auger, the second optical sensor, the right conveyor, and the right auger, the controller configured to:

receive the data characteristic of paving material associated with the left feed mechanism from the first optical sensor;

receive the data characteristic of paving material associated with the right feed mechanism from the second optical sensor; and control each of the left material feed mechanism and the right material feed mechanism independently of each other, wherein speeds of corresponding ones of the left conveyor and the left auger are independently adjusted based on the data received from the first optical sensor and speeds of corresponding ones of the right conveyor and the right auger are independently adjusted based on the data received from the second optical sensor, wherein the first optical sensor is the only sensor associated with the left auger, the first optical sensor being configured to sense an entire length of the left auger, and wherein the second optical sensor is the only sensor associated with the right auger, the second optical sensor being configured to sense an entire length of the right auger.

12. The paving machine of claim 11, wherein the data characteristic of paving material associated with the left feed mechanism includes at least one of:

an amount of paving material adjacent to the left auger;

a flow rate of paving material from the left conveyor to the left auger;

an amount of paving material at the left auger;

a height of paving material at the left auger;

a height of paving material adjacent to the screed assembly; and a segregation of paving material at the left auger.

13. The paving machine of claim 11, wherein the data characteristic of paving material associated with the right feed mechanism includes at least one of:

an amount of paving material adjacent to the right auger;

a flow rate of paving material from the right conveyor to the left auger;

an amount of paving material at the right auger;

a height of paving material at the right auger;

a height of paving material adjacent to the screed assembly; and a segregation of paving material at the right auger.

14. The paving machine of claim 11, wherein each of the first and second optical sensors include one of: a camera, and a LIDAR.

15. The paving machine of claim 11, wherein each of the first and second optical sensors are configured to output data indicative of a height of corresponding ones of the left and right augers from a ground surface to the controller.

16. The paving machine of claim 15, wherein the controller is configured to adjust the heights of corresponding ones of the left and right augers from the ground surface based on the received heights of corresponding ones of the left and right augers from the first and second optical sensors respectively.

* * * * *